US006520423B1

(12) United States Patent
Ricci-Ottati et al.

(10) Patent No.: US 6,520,423 B1
(45) Date of Patent: Feb. 18, 2003

(54) HYDRAULIC INTENSIFIER ASSEMBLY FOR A PIEZOELECTRIC ACTUATED FUEL INJECTOR

(75) Inventors: Giulio Angel Ricci-Ottati, Burton, MI (US); Russell Harmon Bosch, Gaines, MI (US)

(73) Assignee: Delphi Technologies, Inc., Troy, MI (US)

( * ) Notice: Subject to any disclaimer, the term of this patent is extended or adjusted under 35 U.S.C. 154(b) by 195 days.

(21) Appl. No.: 10/025,709

(22) Filed: Jul. 13, 2000

Related U.S. Application Data

(60) Provisional application No. 60/191,020, filed on Mar. 21, 2000.

(51) Int. Cl.[7] ..... F02M 47/02

(52) U.S. Cl. ..... 239/89; 239/90; 239/96

(58) Field of Search ..... 239/88–92, 96

(56) References Cited

U.S. PATENT DOCUMENTS 5,697,342 A * 12/1997 Anderson et al. ..... 123/446
6,234,404 B1 * 5/2001 Cooke ..... 239/533.9

* cited by examiner

*Primary Examiner*—Lisa A. Douglas
(74) *Attorney, Agent, or Firm*—Patrick M. Griffin

(57) ABSTRACT

A piezoelectric actuated fuel injector is provided for use in conjunction with an internal combustion engine. The fuel injector includes a piezoelectric actuator for actuating an injector valve, and a hydraulic assembly for interfacing between the piezoelectric actuator and the injector valve, where the injector valve axially separates from a discharge outlet in response to longitudinal expansion of the piezoelectric actuator, thereby allowing fuel flow from the fuel injector.

22 Claims, 2 Drawing Sheets

HYDRAULIC INTENSIFIER ASSEMBLY FOR A PIEZOELECTRIC ACTUATED FUEL INJECTOR

This application claims the benefit of No. 60/191,020 filed Mar. 21, 2000.

TECHNICAL FIELD

The present invention relates generally to a piezoelectric actuated fuel injector for use in conjunction with an internal combustion engine and, more particularly, to a hydraulic intensifier assembly for interfacing between a piezoelectric actuator and an injector valve of the fuel injector, where the injector valve axially separates from a discharge outlet in response to longitudinal expansion of the piezoelectric actuator, thereby allowing fuel flow from the fuel injector.

BACKGROUND OF THE INVENTION

Piezoelectric elements are attractive candidates as actuator devices for injector valves in common rail fuel injectors. The precise longitudinal deflection characteristic of piezoelectric devices in conjunction with their rapid dynamic response provides the potential of achieving meaningful control over the rate of fuel injection. Additionally, the relative high load capability of piezoelectric elements is consistent with the extremely high pressure environment of common rail fuel injectors.

Generally, a piezoelectric element will experience longitudinal growth when a voltage is applied to it. In this way, the piezoelectric element may be used to actuate the injector valve of a fuel injector. In a known piezoelectric actuated fuel injector, the longitudinal growth of the piezoelectric element actuates the injector valve to a closed position. When the applied voltage is discharged, the piezoelectric element returns to its initial length, thereby actuating the injector valve to an open position.

However, a piezoelectric element exhibits electrical characteristics similar to those of a capacitor. In other words, its operational life is proportional to the time an electric charge is applied to the piezoelectric element. In the above-described configuration, the operational life is significantly reduced by having to apply voltage to the piezoelectric element in order to retain the injector valve in a closed position. Therefore, it is desirable to provide a hydraulic assembly for interfacing between the piezoelectric element and the injector valve, where the longitudinal expansion of the piezoelectric actuator axially separates the injector valve from its valve seat. In other words, no voltage is applied to the piezoelectric element when the injector valve is in a closed position.

SUMMARY OF THE INVENTION

In accordance with the present invention, a piezoelectric actuated fuel injector is provided for use in conjunction with an internal combustion engine. The fuel injector includes a piezoelectric actuator for actuating an injector valve, and a hydraulic assembly for interfacing between the piezoelectric actuator and the injector valve, where the injector valve axially separates from a discharge outlet in response to longitudinal expansion of the piezoelectric actuator, thereby allowing fuel flow from the fuel injector.

For a more complete understanding of the invention, its objects and advantages, refer to the following specification and to the accompanying drawings.

DESCRIPTION OF THE PREFERRED EMBODIMENT

Figure 1:
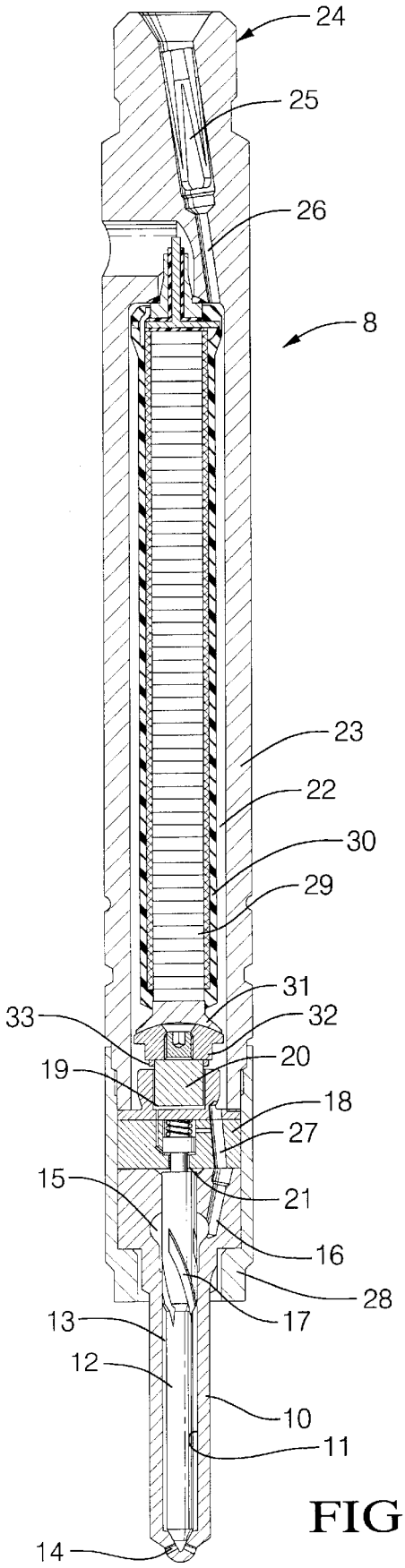
FIG. 1 is a cross-sectional view of an exemplary piezoelectric actuated fuel injector in accordance with the present invention.

An exemplary piezoelectric actuated fuel injector 8 is depicted in FIG. 1. The fuel injector 8 generally includes an injector body 10 having an axially extending fuel passage 11, an injector valve 12 axially movable within the fuel passage 11, a piezoelectric element 29 for actuating the injector valve 12, and a hydraulic assembly 18 for interfacing between the piezoelectric element 29 and the injector valve 12, where the longitudinal expansion of the piezoelectric element 29 axially separates the injector valve 12 from its seating, thereby allowing fuel flow from the fuel injector. While the following description is provided with reference to a particular fuel injector, it is readily understood that the broader aspects of the present invention are applicable to other types of and/or configurations for piezoelectric actuated fuel injectors.

More specifically, the injector valve 12 is reciprocably movable within the fuel passage 11 and shaped for engagement with a valve seat defined at the outlet end of the fuel passage 11. The injector valve 12 further includes a large diameter region and a reduced diameter region. The relatively large diameter region of the injector valve 12 has a diameter substantially equal to the adjacent part of the fuel passage 11. A delivery chamber 13 is defined between the reduced diameter region of the injector valve 12 and the inner surface of the fuel passage 11. It will be appreciated that engagement of the injector valve 12 with the valve seat controls communication between the delivery chamber 13 and one or more discharge outlets 14 located downstream of the valve seat.

The fuel passage 11 is further shaped to define an annular gallery 15 which communicates with a passageway 16 provided in the injector body 10. The injector valve 12 is provided with flutes 17 defining flow paths between the annular gallery 15 and the delivery chamber 13. The injector valve 12 defines an angled step at the interconnection of the relatively large and smaller diameter regions thereof. The angled step of the injector valve 12 forms a thrust surface which is exposed to the fuel pressure within the delivery chamber 13 such that the action of the fuel applies a force to the injector valve 12 urging the valve 12 away from its seating. The exposed end surface of the injector valve 12 similarly forms a thrust surface against which fuel pressure may act to urge the valve towards its seating.

As will be more fully explained below, a hydraulic assembly housing 18 serves as an interface between a piezoelectric actuator 29 and the injector valve 12. The hydraulic assembly 18 is disposed between a top surface of the injector body 10 and a bottom surface of an actuator housing 23. The actuator housing 23 is an elongated form and is provided with a bore defining an accumulator 22. The actuator housing 23 further provides an inlet region 24 arranged to be coupled to a high pressure fuel line (not shown) to permit connection of the fuel injector to a fuel source. The inlet region 24 houses an edge filter member 25 to remove particulate contaminants from the flow of fuel to the injector, thereby reducing the risk of damage to the various components of the injector. The clean side of the edge filter member 25 communicates through a fuel supply passage 26 with the accumulator 22. A second fuel supply passage 27 is provided in the hydraulic assembly housing 18 that permits communication between the accumulator 22 and a passageway 16 provided in the injector body 10. A threaded cap nut 28 is used to secure the injector body 10 and hydraulic assembly housing 18 to the actuator housing 23.

The piezoelectric actuator 29 is located within the accumulator 22. The piezoelectric element of the actuator 29 may be provided with a hermetically sealing coating 30. The coating 30 acts to prevent or restrict the ingress of fuel into the joints between the individual elements forming the piezoelectric actuator 29, thus reducing the risk of damage to the piezoelectric actuator 29. As the piezoelectric actuator is subject to the compressive load applied by the fuel under pressure, the risk of propagation of cracks is also reduced through the use of the coating 30.

Figure 2:
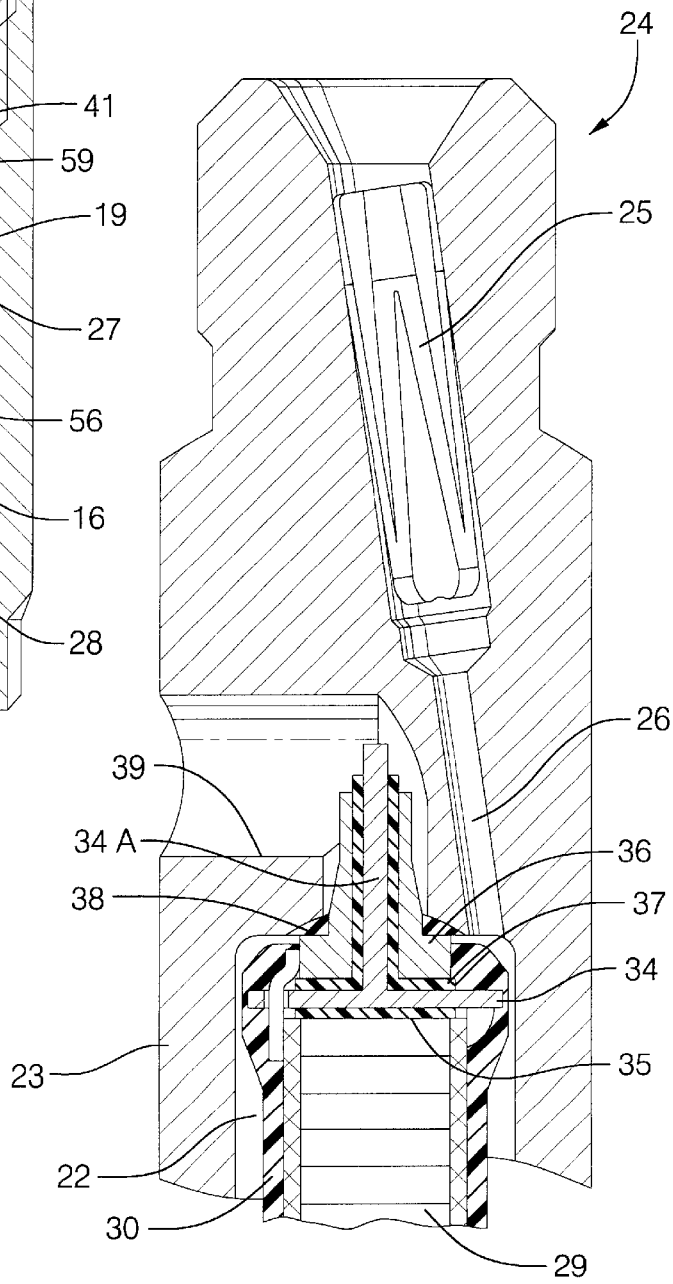
FIG. 2. is a fragmentary cross-sectional view of the exemplary fuel injector illustrating an upper end of the piezoelectric actuator in accordance with the present invention.

Referring to FIG. 2, the upper end of the piezoelectric actuator 29 is secured to a first terminal member 34 using an appropriate adhesive. An insulating spacer member 35 is located between the first terminal member 34 and the end surface of the piezoelectric actuator 29. A second, outer terminal member 36 surrounds a stem 34*a* of the first terminal member 34. Another insulator member 37 is then located between the first and second terminal members. Again, a suitable adhesive is conveniently used to secure these integers to one another. A seal member 38 engages around part of the second terminal member 36. The seal member 38 includes a surface of part-spherical form which is arranged to seat within a correspondingly shaped recess formed around a drilling which opens into an end of the accumulator 22, to compensate for slight misalignments and manufacturing inaccuracies. The first and second terminals 34, 36 extend into a radial drilling 39 provided in the actuator housing 23 whereby appropriate electrical connections can be made to permit control of the piezoelectric actuator. The fuel pressure within the accumulator assists the adhesive in retaining the various components in position.

Figure 3:
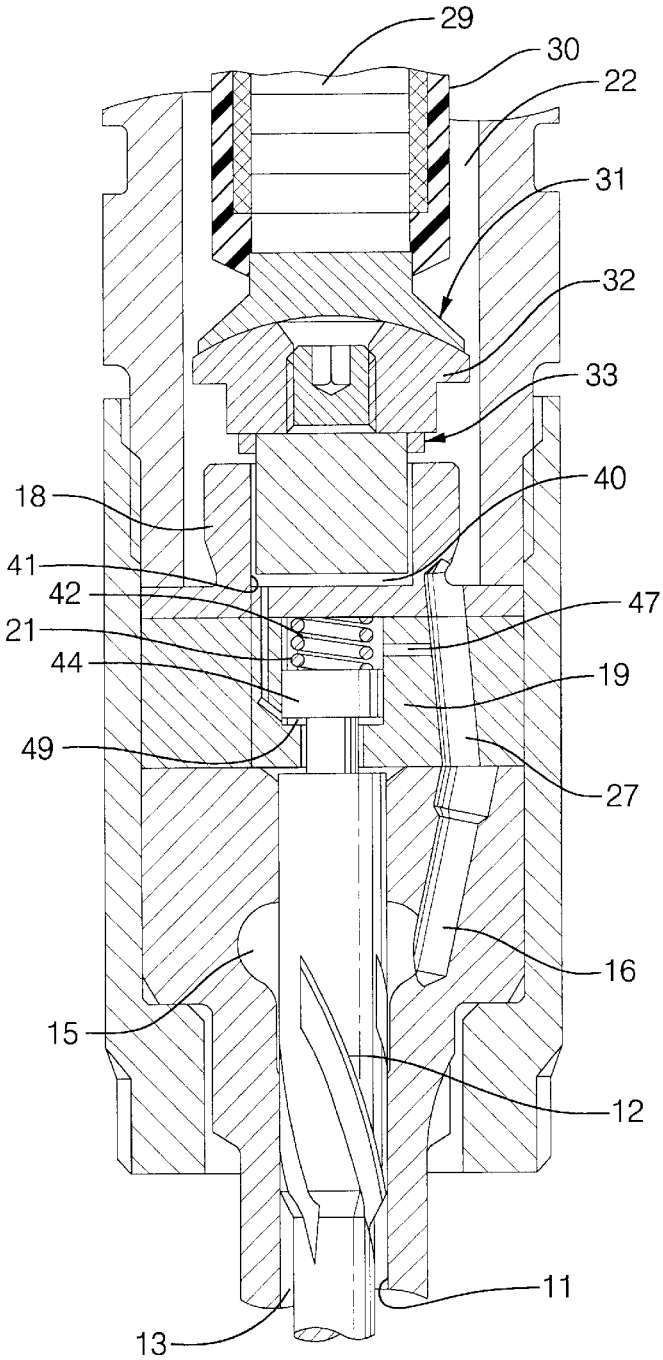
FIG. 3 is a fragmentary cross-sectional view of the exemplary fuel injector illustrating a hydraulic intensifier assembly of the present invention.

At its lower end, the piezoelectric actuator 29 carries an anvil member 31 which is shaped to define a part-spherical recess as best seen in FIG. 3. A load transmitting member 32 including a region of part-spherical form extends into the part-sphencal recess of anvil member 31. The radius of curvature of the part-spherical surface of the load transmitting member 32 is slightly greater than that of the part-spherical recess of the anvil member 31. It will be appreciated, therefore, that the engagement between these components occurs around a substantially circular sealing line adjacent the outer periphery of the anvil member 31, and that a small volume is defined between these components. The cooperation between the anvil member 31 and load transmitting member 32 is such as to define an imperfect seal between these components, the seal being sufficient to restrict the rate at which fuel can flow to the volume defined therebetween from the accumulator 22. The anvil member 31 and load transmitting member 32 collectively define a push rod. Additional information relating to the above-described piezoelectric actuated fuel injector may be found in U.S. Pat. No. 6,234,404 issued to Cooke on May 22, 2001, which is incorporated herein by reference.

In accordance with the present invention, the hydraulic assembly 18 provides an interface between the piezoelectric element 29 and the injector valve 12, where the longitudinal expansion of the piezoelectric element 29 axially separates the injector valve 12 from its seating, thereby allowing fuel flow from the fuel injector. The hydraulic assembly housing 18 further comprises a bore 41 dimensioned to receive the push rod, where a control chamber 40 is formed between an end of the push rod and the inner surface of the bore 41. The hydraulic assembly housing 18 is further defined to include a cavity 42 for housing a control member 44. The control member 44 is in fluid communication through a passageway 48 with the control chamber 40. Thus, the control member 44 is slidably movable within the cavity 42 in accordance with the fluid pressure from the control chamber 40.

By engaging an end surface of the injector valve 12, the control member 44 is operable to control the actuation of the injector valve 12. In a closed position, a spring 21 applies a biasing force to the control member 44 which in turn urges the injector valve 12 towards its valve seat. In order to commence injection, a voltage is applied to the piezoelectric actuator 29. The longitudinal expansion of the piezoelectric element 29 reduces the volume of the control chamber 40, thereby forcing fluid from the control chamber 40. A stepped surface of the control member forms a thrust surface 49 which is exposed to the fluid pressure from the control chamber 40.

As the control member 44 moves away from the injector valve 12, the fluid pressure immediately above the injector valve 12 decreases such that the fuel pressure acting on the thrust surface of the injector valve 12 urges it away from the valve seat, thereby allowing fuel flow from the fuel injector. It will be appreciated that the hydraulic assembly is designed such that the fluid pressure applied to the control member 44 overcomes the biasing force of the spring 21 in order to actuate the control member 44 within the cavity 42 of the housing 18. It should also be noted that a second passageway 47 provides fluid communication between the between the area above the control member 44 in the cavity 42 and the inlet fuel supply passage 27. The purpose of the second passageway 47 is to ensure that the fluid pressure remains close to the rail pressure and independent of the fluid pressure acting on the thrust surface 49 of the control member 44.

In order to terminate injection, the voltage is discharged from the piezoelectric element 29, thereby reducing its axial length and expanding the fluid volume of the control chamber 40. As the fluid pressure acting on the control member 44 decreases, the spring 21 applies a biasing force to the control member 44 which in turn urges the injector valve 12 towards its valve seat. In this way, the injector returns to a closed position.

Figure 4:
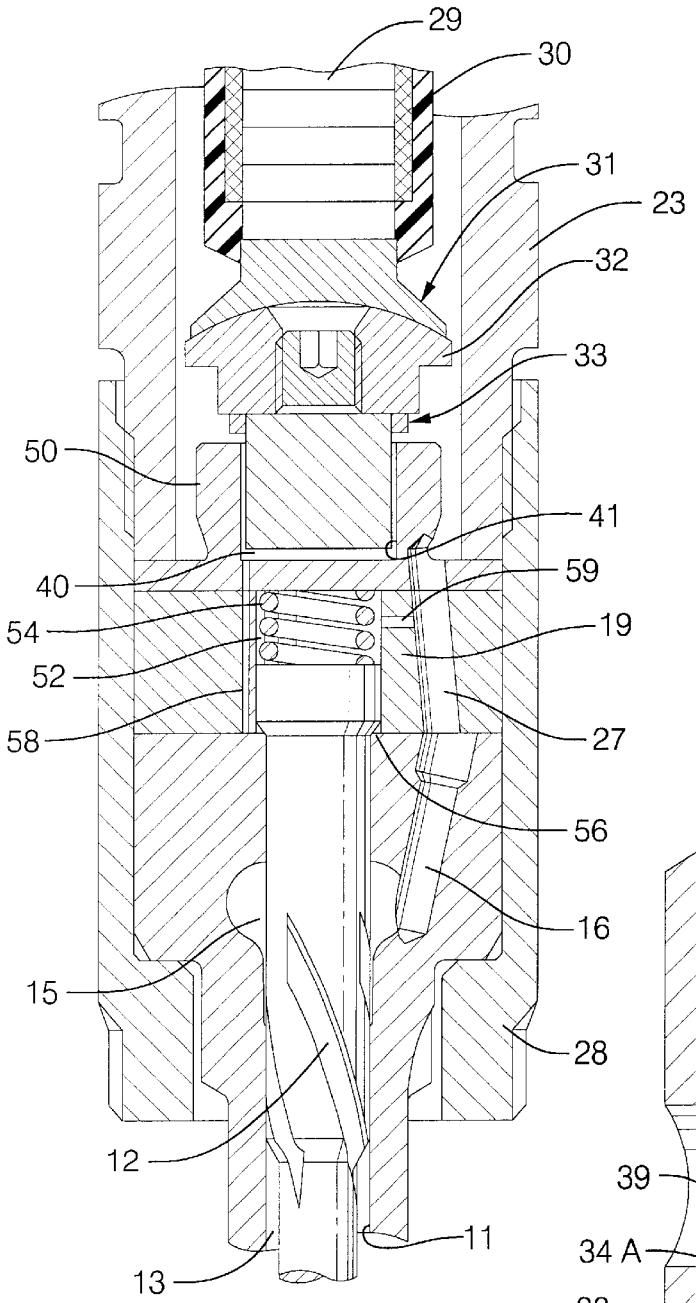
FIG. 4 is a fragmentary cross-sectional view of the exemplary fuel injector illustrating an alternative hydraulic intensifier assembly in accordance with the present invention.

An alternative embodiment for the hydraulic assembly housing 50 is depicted in FIG. 4. The hydraulic assembly housing 50 again comprises a bore 41 dimensioned to receive the push rod, where the control chamber 40 is formed between an end of the push rod and the inner surface of the bore 41. As opposed to providing an internal cavity for the control member, the housing 50 of this embodiment is defined to include a second bore 52 for receiving an end of the injector valve 12. In this case, the actuation of the injector valve 12 is directly controlled by the fluid pressure from the control chamber 40.

A spring 54 is disposed between and inner surface of the second bore 52 and the injector valve 12. In a closed position, the spring 54 biases the injector valve against its valve seat. In order to commence injection, a voltage is applied to the piezoelectric actuator 29. In this embodiment, the injector valve is formed with a second angled surface 56 near the end of the valve received into the second bore of the housing. As previously described, the longitudinal expansion of the piezoelectric element reduces the volume of the control chamber 40, thereby forcing fluid from the chamber. A passageway 58 fluidly connects the control chamber 40 with the second angled surface 56 of the injector valve 12 such that fluid pressure from the control chamber 40 urges the injector valve 12 away from its seating. Again, a second passageway 59 fluidly connects the area above the injector valve 12 with the inlet fuel supply passage 27. In order to terminate injection, the voltage is discharged from the piezoelectric element, thereby reducing its axial length and expanding the fluid volume of the chamber. As the fluid pressure acting on the injector valve 12 decreases, the spring 54 returns to the injector valve to a closed position.

While the above description constitutes the preferred embodiment of the invention, it will be appreciated that the invention is susceptible to modification, variation, and change without departing from the proper scope or fair meaning of the accompanying claims.

What is claimed is:

1. A fuel injector for use in an internal combustion engine, comprising:

an injector body having an axially extending fuel passage therein and at least one discharge opening at an outlet end of the fuel passage;

an injector valve axially movable within the fuel passage;

a piezoelectric element for actuating the injector valve; and a hydraulic assembly for interfacing between the piezoelectric element and the injector valve, where the longitudinal expansion of the piezoelectric element axially separates the injector valve from the discharge opening, thereby allowing fuel flow from the fuel injector.

2. The fuel injector of claim 1 wherein the hydraulic assembly further comprises:

a push rod coupled to an end of the piezoelectric element;

a housing having a bore dimensioned to receive the push rod;

a control chamber for storing a working fluid is formed between the push rod and an inner surface of the bore; and a control member in fluid communication with the control chamber and engaged with an end surface of the injector valve, wherein the control member is operable to actuate the injector valve in accordance with the fluid pressure from the control chamber.

3. The fuel injector of claim 2 wherein the control member is slidably movable in a cavity of the housing.

4. The fuel injector of claim 3 further comprises a passageway from the control chamber to the cavity of the housing.

5. The fuel injector of claim 4 wherein the control member includes a thrust surface exposable to the fluid pressure from the control chamber so as to actuate the control member within the cavity of the housing.

6. The fuel injector of claim 5 wherein the piezoelectric element is operable to actuate the push rod and thereby transmit the working fluid from the control chamber to the thrust surface of the control valve, thereby actuating the control member.

7. The fuel injector of claim 1 wherein the hydraulic assembly further comprises:

a push rod coupled to an end of the piezoelectric element;

a housing having a bore dimensioned to receive the push rod; and a control chamber for storing a working fluid is formed between the push rod and an inner surface of the bore, wherein the injector valve is in fluid communication with the control chamber and is operable to actuate in accordance with the fluid pressure from the control chamber.

8. The fuel injector of claim 7 wherein the injector valve is engageable with a valve seat to control fuel flow and includes a thrust surface exposable to the fluid pressure from the control chamber such that fluid pressure thereto urges the injector valve away from the valve seat.

9. The fuel injector of claim 8 further comprising a passageway between the control chamber and the thrust surface of the injector valve.

10. The fuel injector of claim 8 wherein the piezoelectric element is operable to actuate the push rod and thereby transmit the working fluid from the control chamber to the thrust surface of the injector valve, thereby urging the injector valve away from the valve seat.

11. The fuel injector of claim 8 further comprising a spring positioned between the housing and an end surface of the injector valve for biasing the injector valve against the valve seat.

12. A hydraulic intensifier assembly for interfacing between a piezoelectric element and an injector valve in a piezoelectric actuated fuel injector, comprising:

a push rod coupled to an end of the piezoelectric element;

a housing having a bore dimensioned to receive the push rod;

a control chamber for storing a working fluid is formed between the push rod and an inner surface of the bore; and a control member in fluid communication with the control chamber and engaged with an end surface of the injector valve, wherein the control member is operable to actuate the injector valve in accordance with the fluid pressure from the control chamber.

13. The hydraulic intensifier assembly of claim 12 wherein the control member is slidably movable in a cavity of the housing.

14. The hydraulic intensifier assembly of claim 13 further comprises a passageway from the control chamber to the cavity of the housing.

15. The hydraulic intensifier assembly of claim 13 wherein the control member includes a thrust surface exposable to the fluid pressure from the control chamber so as to actuate the control member within the cavity of the housing.

16. The hydraulic intensifier assembly of claim 15 wherein the piezoelectric element is operable to actuate the push rod and thereby transmit the working fluid from the control chamber to the thrust surface of the control valve, thereby actuating the control member.

17. The hydraulic intensifier assembly of claim 15 further comprising a spring disposed in the cavity of the housing for biasing the control member into engagement with the injector valve.

18. A hydraulic intensifier assembly for interfacing between a piezoelectric element and an injector valve in a piezoelectric actuated fuel injector, comprising:

a push rod configured for being coupled to an end of the piezoelectric element, said push rod occupying a first position when said piezoelectric element is not energized, said pushrod when in said first position configured for placing the injector valve in a closed position;

a housing having a bore, said push rod slidably disposed within said bore; and a control chamber for storing a working fluid is defined between said push rod and an inner surface of the bore, said push rod configured for being translated out of said first position by said piezoelectric element to thereby increase the fluid pressure within said control chamber and to thereby open said valve.

19. The hydraulic intensifier assembly of claim 18 wherein the injector valve is engageable with a valve seat to control fuel flow and includes a thrust surface exposable to the fluid pressure from the control chamber such that fluid pressure thereto urges the injector valve away from the valve seat.

20. The hydraulic intensifier assembly of claim 19 further comprising a passageway between the control chamber and the thrust surface of the injector valve.

21. The hydraulic intensifier assembly of claim 19 wherein the piezoelectric element is operable to actuate the push rod and thereby transmit the working fluid from the control chamber to the thrust surface of the injector valve, thereby urging the injector valve away from the valve seat.

22. The hydraulic intensifier assembly of claim 19 further comprising a spring positioned between the housing and an end surface of the injector valve for biasing the injector valve against the valve seat.

* * * * *